US005500330A

United States Patent [19]

Szajewski et al.

[11] Patent Number: 5,500,330

[45] Date of Patent: Mar. 19, 1996

[54] PHOTOGRAPHIC MATERIAL AND PROCESS COMPRISING A THIOL BEACH ASSIST IN THE LOW SENSITIVITY LAYER OF A TRIPLE-COAT

[75] Inventors: Richard P. Szajewski; Allan F. Sowinski, both of Rochester, N.Y.

[73] Assignee: Eastman Kodak Company, Rochester, N.Y.

[21] Appl. No.: 269,998

[22] Filed: Jul. 1, 1994

Related U.S. Application Data

[63] Continuation of Ser. No. 11,451, Jan. 29, 1993, abandoned.

[51] Int. Cl.[6] ..... G03C 7/00; G03C 5/44; G03C 1/46; G03C 1/005

[52] U.S. Cl. ..... 430/393; 430/505; 430/611; 430/955; 430/566; 430/430; 430/553; 430/543; 430/544

[58] Field of Search ..... 430/393, 505, 430/566, 611, 955, 430, 552, 553, 543, 544

[56] References Cited

U.S. PATENT DOCUMENTS

| | | | |
|---|---|---|---|
| 4,842,994 | 6/1989 | Sakanoue et al. | 430/543 |
| 4,865,959 | 9/1989 | Sakanoue et al. | 430/430 |
| 5,183,727 | 2/1993 | Schmittou et al. | 430/372 |
| 5,219,715 | 6/1993 | Sowinski et al. | 430/505 |
| 5,262,287 | 11/1993 | Deguchi et al. | 430/504 |

FOREIGN PATENT DOCUMENTS

| | | | |
|---|---|---|---|
| 0193389A | 10/1990 | European Pat. Off. . | |
| 0193389 | 10/1990 | European Pat. Off. . | |
| 0456181 | 5/1991 | European Pat. Off. | 430/544 |
| 2-113242 | 4/1990 | Japan | 430/955 |

*Primary Examiner*—Charles L. Bowers, Jr.
*Assistant Examiner*—J. Pasterczyk
*Attorney, Agent, or Firm*—Arthur E. Kluegel

[57] ABSTRACT

A photographic element comprises at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol-containing compound or precursor contained in such layers is both sufficient to increase the extent of silver bleaching during bleaching and is greater than the amount contained in any of the more sensitive layers of the same sensitivity; and B. the thiol fragment contains a sulfur atom which is not directly bonded to an aromatic atom and contains a water-solubilizing group.

38 Claims, No Drawings

PHOTOGRAPHIC MATERIAL AND PROCESS COMPRISING A THIOL BEACH ASSIST IN THE LOW SENSITIVITY LAYER OF A TRIPLE-COAT

This is a Continuation of application U.S. Ser. No. 011,451, filed 29 Jan. 1993 now abandoned.

FIELD OF THE INVENTION

This invention relates to the photographic arts and more specifically to photographic elements and processes which employ a particular thiol bleach assist compound in association with the least sensitive of three layers sensitized to the same spectral region.

BACKGROUND OF THE INVENTION

The basic image-forming process of color negative photography involves the exposure of the silver halide photographic recording material to light, and the manifestation of the recorded image by treatment of the material with a series of aqueous chemical processing solutions. The fundamental steps of this processing entail, first, color development of the recording material wherein some or all of the silver halide is reduced to metallic silver forming an organic dye from the reaction of oxidized color developer and incorporated coupling compounds, and, second, the removal of the metallic silver and residual silver halide by the steps of bleaching and fixing. Herein, the metallic silver is oxidized by a ferricligand complex in the bleach, and the silver ion derived from bleaching, as well as the remaining silver halide, are dissolved away by conversion to a soluble silver complex by the fixing agent.

It is highly desirable to process a photographic recording material as rapidly as possible. The post-development silver removal steps in fact consume more than half of the total process time already, and shortening this segment of the process appears opportune. But juxtaposed with this desire to increase processing speed is the problem that the processing solutions employed in the commercial trade are generally less effective and potent as used in practice than their initial fresh composition would indicate, due to the deleterious effects of process seasoning and underreplenishment. In particular, the performance of the bleach solution is degraded by carryover of the developer solution into the bleach solution, resulting not only in dilution of the bleach solution, but also drift from its optimum low pH by neutralization caused by the basic, high pH developer. The effectiveness of the bleach is diminished, and metallic silver retention occurs, reducing the quality of the resultant photographic image. A useful approach to ameliorate such poor bleaching is to incorporate a bleaching accelerator in the photographic recording material itself.

Light sensitive color negative photographic materials generally comprise three color units or records, each sensitive to a different region of the electromagnetic spectrum. A typical arrangement is to provide a color record comprising an emulsion sensitive to red light having in reactive association a cyan dye forming coupler, a color record comprising an emulsion sensitive to green light having in reactive association a magenta dye forming image coupler, and a color record comprising an emulsion sensitive to blue light having in reactive association a yellow dye forming image coupler.

The use of more than one light sensitive layer in a color record is well established in the photographic arts. Use of three layers each sensitized to the same spectral region but differing in degree of sensitivity is described, for example, in U.S. Pat. No. 3,843,369. Such an arrangement is also known as a "triple-coat". This arrangement is preferred in some circumstances because it is said to provide desirable granularity characteristics.

The incorporation of compounds that release solubilized aliphatic or solubilized aromatic mercaptans as a bleach accelerator directly into photographic recording materials is taught in the art. European Patent 0,193,389A discloses the use of compounds capable of releasing solubilized aliphatic and aromatic mercaptans as bleach accelerator releasing compounds (BARCs). This publication does not specifically describe the use of BAR compounds in triple-coat structures.

More recently, European Patent 0,456,181 has described the use of BARCs in multilayer, multicolor films employing triple-coated records. This usage is said to provide improved bleaching. The examples specifically disclosed in this publication illustrate the localization of the BARCs in the most light sensitive layers of the triple-coated records or the indiscriminate addition of BARCs to many layers of the film. Compounds capable of releasing solubilized aliphatic or solubilized aromatic mercaptans as a bleach accelerator are described.

Japanese Kokai 02/113,242 also discloses the use of BARCs in triple-coated red or green light sensitive color records and specifically recommends localizing the BARCs in the most light sensitive layers of a red or green color record so as to provide improved bleaching characteristics. Compounds capable of releasing solubilized aliphatic or solubilized aromatic mercaptans as bleach accelerator are described.

U.S. Pat. No. 4,865,959 again discloses triple-coated red light sensitive color records. It teaches that bleaching and color reproduction can be improved by selecting a specific and narrow sub-class of cyan dye-forming image couplers and by simultaneously incorporating BARCs in the most light sensitive layer of the triple-coat structure. Compounds capable of releasing solubilized aliphatic or solubilized aromatic mercaptans as bleach accelerator are described.

Compounds capable of releasing solubilized aliphatic mercaptans incorporated in multicolor photographic recording materials as agents to reduce processing variability have been disclosed in publications of foreign counterparts to U.S. patent application Ser. No. 708,546, filed on 31 May 1991. Such incorporation has been carried out in the highest sensitivity blue sensitive layers or distributed between the high and low sensitivity layers of a 2-layer blue sensitive color record. The level of bleach accelerator is less than that required to detectably improve the bleachability of the photographic recording material. This application does not teach improved bleachability.

The incorporation of compounds capable of releasing solubilized aliphatic or solubilized aromatic mercaptans as a bleach accelerator directly in the photographic recording material at a level that is effective in ameliorating seasoned bleach performance can have pronounced side effects on the sensitometric performance and color reproduction performance of the material, however. In particular, the developability of the light sensitive unit(s) incorporating the accelerator can increase, resulting in an increased contrast or gamma function (henceforth gamma) for the color record involved. In turn, the increased developability or rate of development of the color unit can reduce or completely eliminate the interlayer chemical inhibition interactions between color units that results in good color saturation and hue reproduction. Thus the tone scale and color reproduction of the recording material may be severely compromised by measures necessary to ensure adequate bleachability.

A problem to be solved is to provide a photographic element and process which will produce images having improved color reproduction and which will enable improved silver bleaching, particularly in the instance where seasoned bleach is employed during processing.

SUMMARY OF THE INVENTION

The invention provides novel photographic elements and processes. The photographic element comprises at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of said compound or precursor contained in such layers is both sufficient to increase the extent of silver bleaching during bleaching and is greater than the amount contained in any of the more sensitive layers of the same sensitivity; and B. said thiol fragment contains a sulfur atom which is not directly bonded to an aromatic atom and contains a water-solubilizing group.

The invention provides improved bleaching of and color reproduction in color photographic elements.

DETAILED DESCRIPTION OF THE INVENTION

The photographic element comprises at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an aromatic atom and the thiol fragment also contains a water-solubilizing group.

The thiol fragment containing compound is represented by the formula:

$$CAR—L_nSR'R''$$

wherein CAR is a carrier moiety capable of releasing —$L_n$SR'R", L is a divalent linking or timing group (T) which releases —SR'R" as a group during processing; n is 0 to 3; R' is a substituent group which is connected to S through other than an aromatic atom; and R" is a water solubilizing group.

The CAR group can be any moiety suitable for releasing —$L_n$SR'R" as a unit during the photographic development step. Most typically CAR will be a coupler moiety. Alternatively, CAR can be a redox compound or a polymer. CAR can release the fragment as a result of a coupling reaction with oxidized developer, as a result of a redox reaction, or as a result of reaction with nucleophiles such as hydroxide, hydroxylamine, sulfite and so forth.

There follows a listing of patents and publications that describe coupling groups useful for carrying —$L_n$SR'R".

A. Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961).

Preferably such couplers are phenols and naphthols that form cyan dyes on reaction with oxidized color developing agent and have the linking or timing group attached at the coupling position, that is the carbon atom in the 4-position.

B. Couplers that form magenta dyes upon reaction with oxidized color developing agent are described in such representative patents and publications as: U.S. Pat. Nos. 2,600,788, 2,369,489, 2,343,703 2,311,082, 3,152,896, 3,519,429, 3,062,653, 2,908,573 and "Farbkuppler-eine LiteratureUbersicht," published in Agfa Mitteilungen, Band III, pp. 126–156 (1961).

Preferably such couplers are pyrazolones, pyrazolotriazoles, or pyrazolobenzimidazoles that form magenta dyes upon reaction with oxidized color developing agents and have the —SR'R" attached to the coupling position.

C. Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961).

Preferably such yellow-dye forming couplers are acylacetamides, such as pivaloyl- or benzoylacetanilides and have the —SR'R" group attached to the coupling position, that is the active methylene carbon atom.

D. Couplers that form colorless products upon reaction with oxidized color developing agent are described in such representative patents as: U.K. Patent No. 861, 138; U.S. Pat. Nos. 3,632,345, 3,928,041, 3,958,993 and 3,961,959. Preferably such couplers are cyclic carbonyl containing compounds that form colorless products on reaction with oxidized color developing agent and have the —SR'R" group attached to the carbon atom in the alpha-position with respect to the carbonyl group.

E. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764.

Preferably such couplers are resorcinols or m-aminophenols that form black or neutral products on reaction with oxidized color developing agent and have the BAR fragment group para to a hydroxy group.

In addition to the foregoing, it is apparent that so-called washout couplers may be employed. Thus, for example, a naphthol having an unsubstituted carbamoyl or one substituted with a low molecular weight substituent at the 2- or 3-position and the BAR fragment at the 4- position may be employed.

The water-solubilizing groups useful as R" are groups well-known in the art that tend to increase or enhance the water solubility of organic compounds. R" can optionally be a precursor to a water solubilizing group. The following R"

groups are examples of useful water solubilizing groups and their precursors:

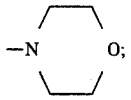

—COOH; —$SO_3H$; —OH; —$SO_2NHCH_3$; —$SO_2NH_2$; and —$NR^5R^6$ wherein $R^5$ is H or alkyl of 1 to 4 carbons, $R^6$ is alkyl of 1 to 4 carbons and the total carbon atoms in $R^5$ and $R^6$ is no more than 8.

The following are examples of useful R' groups:

—$CH_2$—; —$CH_2CH_2$—; —$CH_2CH_2CH_2$—; —$CH_2CH(CH_3)CH_2$—; —$(CH_2)_4$—; —$CH_2CH(C_2H_5)CH_2CH_2$—; —$CH_2CH_2CH(CH_3)CH_2$ —; —$CH(CH_3)CH_2$—; —$CH_2CH_2OCH_2CH_2$—.

Examples of —R'R" moieties include:

—$CH_2CH_2CO_2H$; —$CH_2CH_2OCH_2CH_2OH$; —$CH(CH_3)CH_2CO_2H$; —$CH_2CH_2N(CH_3)_2$; —$CH_2CO_2H$; —$CH(CH_3)CH(CH_3)CO_2H$; —$(CH_2)_4CO_2H$; —$CH_2CH(OH)_2$; —$CH_2CH_2SCH_2CH_2CO_2H$; —$CH_2CH(OH)CH_2CO_2H$; —$CH_2NHC(O)CH_2CH_2CO_2H$;

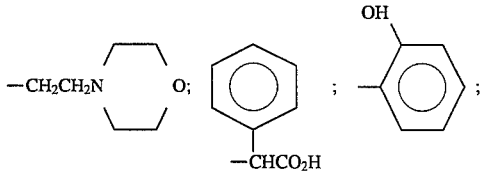

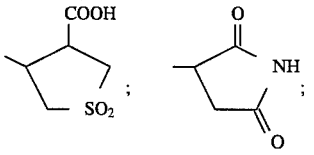

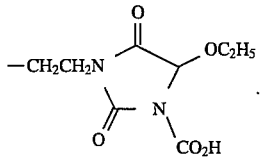

L is a linking group which, if desired, may be a timing group (T). Suitably, L may be any divalent group capable of releasing —SR'R" as a group such as alkylene, arylene and combinations thereof, interrupted or not by a heteroatom or heterogroup, all substituted or unsubstituted.

The timing group (T) is joined to the coupler moiety at any of the positions from which groups released from couplers by reaction with oxidized color developing agent can be attached. Preferably, the timing group is attached at the coupling position of the coupler moiety so that upon reaction of the coupler with oxidized color developing agent the timing group will be displaced. However, the timing group can be attached to a non-coupling position of the coupler moiety from which it will be displaced as a result of reaction of the coupler with oxidized color developing agent. In the case where the timing group is at a non-coupling position of the coupler moiety, other groups can be in the coupling position, including conventional coupling-off groups or the same or different thiol fragments or precursors from that contained in the described thiol fragment or precursor moiety of the invention. Alternatively, the coupler moiety can have a timing group at each of the coupling position and a non-coupling position. Accordingly, couplers of this invention can release more than one mole per mole of coupler. These released fragments can be the same or different and can be released at the same or different times and rates.

The timing group can be any organic group that will serve to connect the coupler to the thiol fragment or precursor moiety and which, after cleavage from the coupler, will cleave from the BAR moiety preferably by an intramolecular nucleophilic displacement reaction of the type described in, for example, U.S. Pat. No. 4,248,962 or by electron transfer down a conjugated chain as described in, for example, U.S. Pat. No. 4,409,323 (quinone-methide types), the disclosures of which are incorporated herein by reference. Timing groups utilizing the mechanism in which there is electron transfer down a conjugated chain are especially preferred. U.S. Pat. Nos. 4,842,994 and 5,135,839 contain a detailed explanation of timing groups which may be suitable for use in the invention.

The term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have a nucleophilic group and an electrophilic group spatially related by the configuration of the molecule to promote reactive proximity. Preferably the nucleophilic group and the electrophilic group are located in the compound so that a cyclic organic ring, or a transient cyclic organic ring, can be easily formed by an intramolecular reaction involving the nucleophilic center and the electrophilic center.

A useful illustrative class of timing group (T) is represented by the structure:

—(Nu—X—S)

wherein:

Nu is a nucleophilic group attached to a position on the coupler from which it will be displaced upon reaction of the coupler with oxidized color developing agent, E is an electrophilic group attached to the BAR fragment as described and is displaceable therefrom by Nu after Nu is displaced from the coupler; and X is a linking group for spatially relating Nu and E, upon displacement of Nu from the coupler, to undergo an intramolecular nucleophilic displacement reaction with the formation of a 3- to 7- (preferably 5- or 6-) membered ring and thereby release —SR'R".

A nucleophilic group (Nu) is understood to be a grouping of atoms wherein one of which is electron rich. This atom is referred to as the nucleophilic center. An electrophilic group (E) is understood to be a grouping of atoms wherein one of which is electron deficient. This atom is referred to as the electrophilic center.

In photographic couplers as described, the timing group can contain a nucleophilic group and an electrophilic group that are spatially related with respect to one another by a linking group so that upon release from the coupler moiety, the nucleophilic center and the electrophilic center will react to effect displacement of the fragment from the timing group. The nucleophilic center should be prevented from reacting with the electrophilic center until release from the coupler moiety and the electrophilic center should be resistant to external attack such as hydrolysis. Premature reaction can be prevented by attaching the coupler moiety to the timing group at the nucleophilic center or at an atom in conjunction with a nucleophilic center, so that cleavage of the timing group and the bleach accelerator moiety from the coupler moiety unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups, or precursors thereof, which may remain attached to the timing group or be released.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

Especially preferred are those timing groups having the structure:

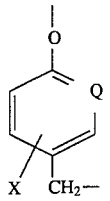

wherein X is hydrogen or one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido and sulfonamide; and Q is —N= or —C(W)=;

wherein W is an electron donating group characterized by a sigma-para value greater than 0 (as determined as described in , *Journal of Medicinal Chemistry*, Hansch and Leo, 16, 1207, (1973). Typical W groups are —NO2,—$NHSO_2CH_3$, —$NHSO_2C_{16}H_{33}$, —$NHCOCH_3$, —$NHCOC_{11}H_{23}$, —Cl, —Br, —$OCH_3$, —$OCH_2CH_2OCH_3$, etc. Other useful timing groups are described in U.S. Pat. Nos. 4,737,451; 4,546,073; 4,564,587;4,618,571; 4,698,297 and European Published Patent Applications 167,168A, 255,085A, and 362,870A.

The timing group can contain moieties and substituents that will permit control of one or more of the rates of reaction of the coupler with oxidized color developing agent, the rate of diffusion of —LSR'R" once it is released from the coupler, and the rate of release of —SR'R". The timing group can contain added substituents, such as added photographically useful groups, that can remain attached to the timing group and be released independently. The timing groups can contain a ballast group.

Specific examples of BAR compounds that are usable in accordance with the invention are as follows:

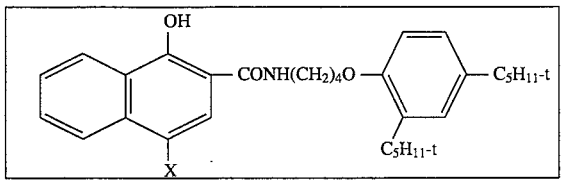

X = —S—$CH_2CH_2CO_2H$ B-1

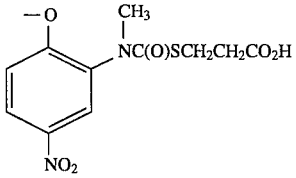

B-2

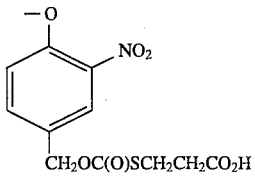

B-3

—$SCH(CH_3)CH_2CO_2H$ B-4

—$SCH_2CH_2OCH_2CH_2OH$ B-5

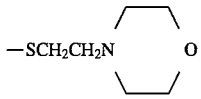

B-6

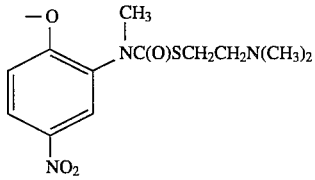

B-7

-continued
| | |
|---|---|
| $-SCH_2CO_2H$ | B-8 |
| $-SCH(CH_3)CH(CH_3)CO_2H$ | B-9 |
| $-SCH(C_4H_9)CO_2H$ | B-10 |
| $-S(CH_2)_4CO_2H$ | B-11 |
| $-SCH_2CH(CH_2OH)OH$ | B-12 |
| $-SCH_2CH_2OCH_2CH_2CO_2H$ | B-13 |
| $-SCH_2CH(OH)CO_2H$ | B-14 |
| 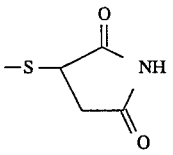 | B-15 |
| 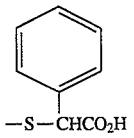 | B-16 |
| 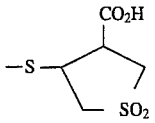 | B-17 |
| 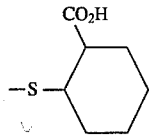 | B-18 |
| 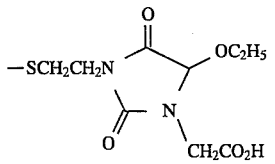 | B-19 |
| $-SCH_2CH_2SO_3H$ | B-20 |
| $-SCH_2CH_2OH$ | B-21 |
| 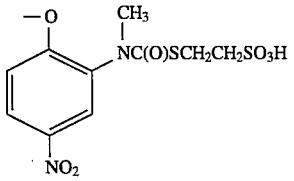 | B-22 |
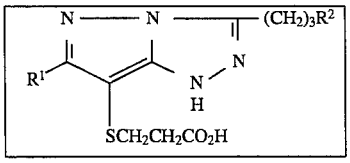
$R^1 = -CH_3$
$R^2 =$ 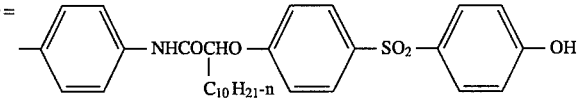 B-23

-continued
B-24
$R^1 =$
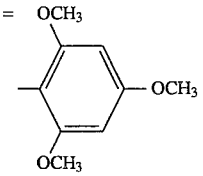
$R^2 =$
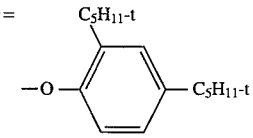
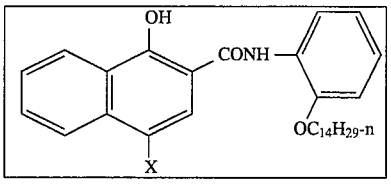
X = $-SCH_2CH_2CO_2H$ B-25
$-SCH_2CO_2H$ B-26
$-OCOSCH_2CH_2CO_2H$ B-27
B-28
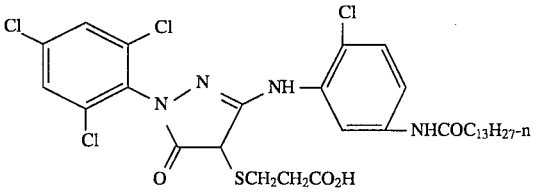
B-29
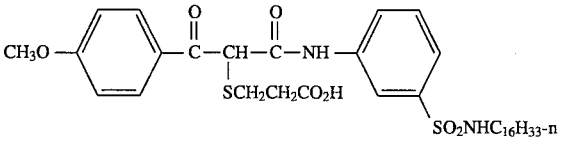
B-30
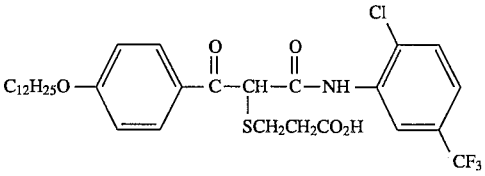
B-31
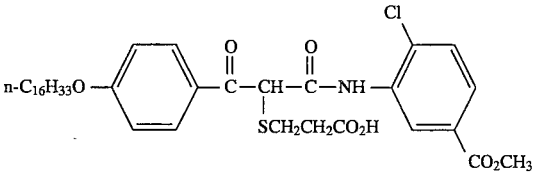
B-32
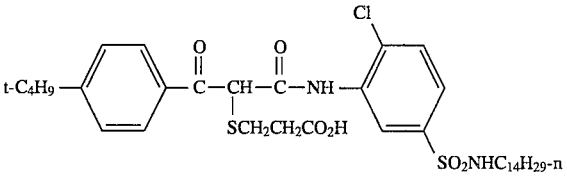

-continued
B-33
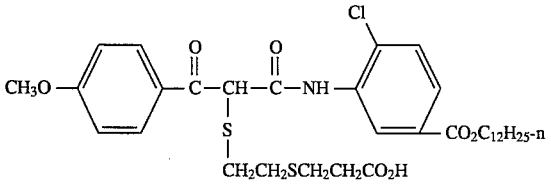
B-34
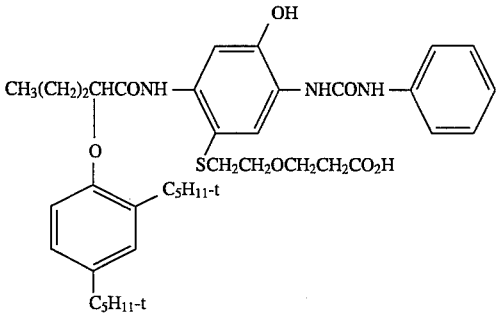
B-35
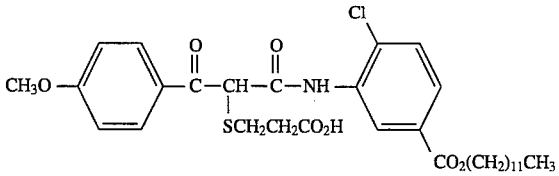
B-36
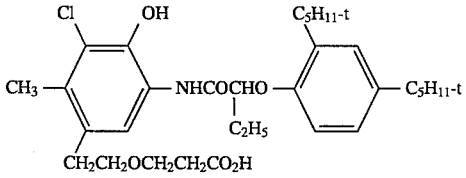
B-37
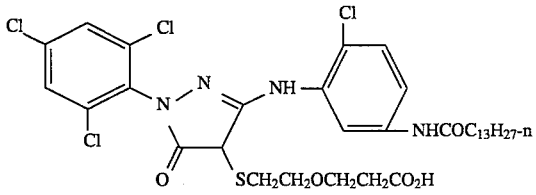
B-38
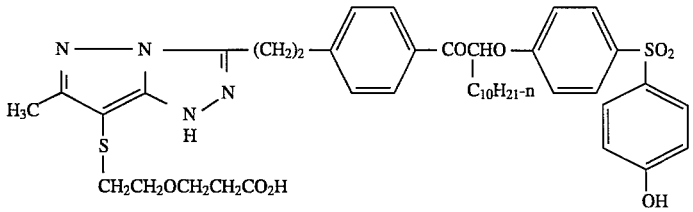
B-39
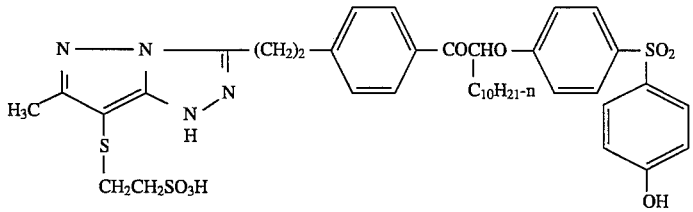
B-40
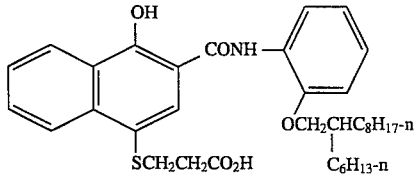

-continued
B-41
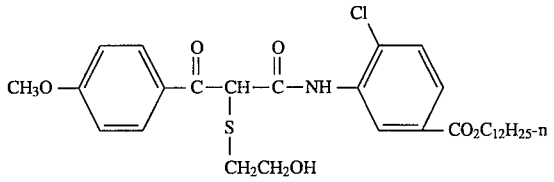
B-42
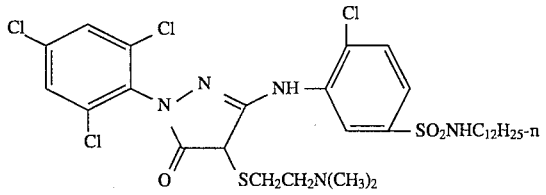
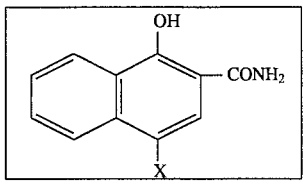
B-43
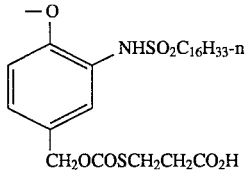
B-44
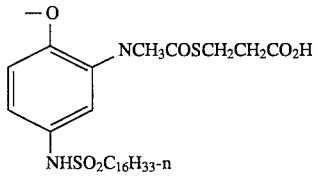
B-45
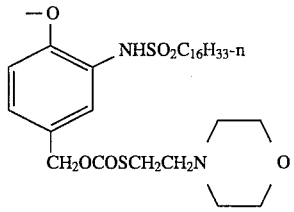
B-46
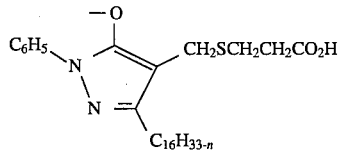

-continued

B-47

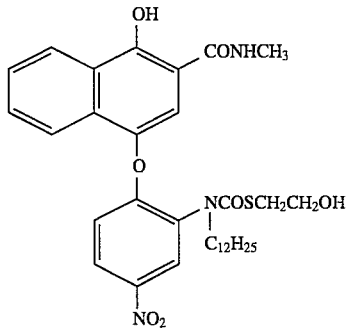

In order to obtain effective clearing of retained silver from the photographic recording material when processed through a degraded bleach bath, the level BAR compound exemplified by compound B-1 in the red-sensitive color unit totals at least about 0.038 g/sq.m, and it may exceed 0.27 g/sq.m. In a preferred form of the invention, the total level of incorporated BAR compound exemplified by compound B-1 is about 0.13 g/sq.m. In the most preferred form of the invention, the total level of BAR compound exemplified by compound B-1 is about 0.09 g/sq.m. The BAR compound is placed at the greatest level contained within the particular color unit of the photographic recording material in the least sensitive emulsion layer of the unit. In a preferred form of the invention, the highest sensitivity layer and the medium sensitivity layer of the unit contains less than about 0.02 g/sq.m each of the BAR compound exemplified by compound B-1. In the most preferred form of the invention, BAR compound is absent from the highest and medium sensitivity layers of the unit.

The compound capable of releasing a solubilized aliphatic or solubilized aromatic mercaptan, or a precursor thereof, as a bleach accelerator may be placed in any or all of the red-sensitive, the green-sensitive, or the blue-sensitive color units to improve the bleachability of the photographic recording material. In preferred forms of the invention, the red light sensitive color unit is closest to the support, and it comprises the BAR compound at the highest potency found in the color photographic recording material owing to a combination of usual factors such as compound laydown, reactivity, thiol fragment bleach accelerating efficacy, and so forth. The color unit comprising the BAR compound may have three, or more, emulsion layers, each spectrally sensitized to the same color of light, differing in sensitivity; the layers may be contiguous or they may be spatially separated by layer(s) of differing spectral sensitivity and differing image dye hue, or by layer(s) that are not light sensitive. It is generally preferred to employ the invention in color units comprising three or more contiguous layers.

The BAR compound is placed at its highest level in the least sensitive layer of the color unit. If more than one BAR compound is used in the unit, then it is understood that the invention employs the highest potency of bleach acceleration in the least sensitive layer of the unit, where the realized bleach acceleration results from a combination of factors such as compound laydown, relative reactivity, timing or linking group effects if any were present, and thiol fragment bleach accelerating efficacy, as will be appreciated by those who are skilled in the art. Alternatively the BAR compound may be placed in a nonsensitive layer in reactive association with the least sensitive layer of the color unit at the highest level associated with the color unit. It is usually preferred to employ the invention by placement of the BAR in the least light sensitive layer of the color unit itself.

As used herein, the term substituent has a broad definition. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2- (2,4-di-t-pentylphenoxy-)ethoxy, and 2-dodecyloxyethoxy; aryl such as phenyl, 4-t-butylphenyl, 2,4,6-trimethylphenyl, naphthyl; aryloxy, such as phenoxy, 2 -methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxopyrrolidin-1-yl, 2-oxo-5 -tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5 -(di-t-pentylphenyl-)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido; and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 30 carbon atoms and usually less than 24 carbon atoms, but greater numbers are possible depending on the particular substituents selected. Moreover, as indicated, the substituents may themselves be suitably substituted with any of the above groups.

The compositions of the invention can be used in any of the ways and in any of the combinations in which such compositions are used in the photographic art. Typically, they are incorporated in a silver halide emulsion and the emulsion coated on a support to form part of a photographic element. Alternatively, they can be incorporated at a location adjacent to the silver halide emulsion where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, amyloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

The photographic elements can be single color elements or multicolor elements. Multicolor elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

If desired, the photographic element can be used in conjunction with an applied magnetic layer as described in *Research Disclosure*, Nov. 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455, 169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006, 755A and 2,017,704A, the disclosures of which are incorporated herein by reference.

It may be useful to use a combination of couplers any of which may contain known ballasts or coupling-off groups such as those described in U.S. Pat. Nos. 4,301,235; 4,853, 319 and 4,351,897. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643, 965. The masking couplers may be shifted or blocked.

The compositions may also be used in association with materials that accelerate or otherwise modify the processing steps e.g. of bleaching or fixing to improve the quality of the image. Bleach accelerator releasing couplers other than those described herein, such as those described in EP 193, 389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097, 140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

For example, the invention may be included as an addition or substitution in a color negative photographic element comprising a support bearing the following layers from top to bottom:

(1) one or more overcoat layers containing ultraviolet absorber(s);

(2) a double-coat yellow pack with a fast yellow layer containing "Coupler 1": Benzoic acid, 4-chloro-3 -((2-(4-ethoxy-2,5-dioxo-3-(phenylmethyl)-1 -imidazolidinyl)-3-(4-methoxyphenyl)-1,3 -dioxopropyl)amino)-, dodecyl ester and a slow yellow layer containing the same compound together with "Coupler 2": Propanoic acid, 2-[[5-[[4-[2-[[[2,4 -bis(1,1-dimethylpropyl)phenoxy]acetyl]amino]-5 -[(2,2,3,3,4,4,4-heptafluoro-1-oxobutyl) amino]-4-hydroxyphenoxy]-2,3-dihydroxy-6-[(propylamino) carbonyl ]phenyl]thio]-1,3,4-thiadiazol-2-yl]thio]-, methyl est and "Coupler 3": 1-((dodecyloxy)carbonyl) ethyl(3 -chloro-4-((3-(2-chloro-4-((1-tridecanoylethoxy) carbonyl)anilino) -3-oxo-2-((4) (5) (6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4 -bis(1, 1-dimethylpropyl)phenoxy)-1-oxobutyl)amino)-N-(4, 5-dihydro-5-oxo-1-(2,4,6-trichlorophenyl)-1 H-pyrazol-3-yl)-, "Coupler 5": Benzamide, 3-((2-(2,4 -bis(1, 1-dimethylpropyl)phenoxy)-1-oxobutyl)amino)-N-( 4',5'-dihydro-5'-oxo-1'-(2,4,6-trichlorophenyl) (1,4' -bi-1H-pyrazol)-3'-yl)-, "Coupler 6": Carbamic acid, (6 -(((3-(dodecyloxy)propyl) amino)carbonyl)-5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1 H-pyrazol-3-yl)-; a mid-magenta layer and a slow magenta layer each containing "Coupler 9": 2-Propenoic acid, butyl ester, styrene, 2:1:1 polymer with (N [1-(2,4,6-trichlorophenyl)-4,5-dihydro-5-oxo-1H-pyrazol-3-yl]-2 -methyl-2-propenamide)$_2$ and "Coupler 10": Tetradecanamide, N-(4-chloro-3-((4-((4-((2, 2-dimethyl-1-oxopropyl) amino)phenyl)azo)-4,5-dihydro-5-oxo-1 -(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1 -dimethylpropyl)phenoxy) propyl)amino)carbonyl)-4 -hydroxy-1-naphthalenyl) oxy)ethoxy)phenyl)azo)-4 -hydroxy-, disodium salt; and a slow cyan layer containing Couplers 2 and 6;

(7) an undercoat layer containing Coupler 8; and (8) an antihalation layer.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the materials may be blocked or coated in protected form as described, for example, in Japanese Application 61/258,249 or U.S. Pat. No. 5,019,492.

The materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIR) couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

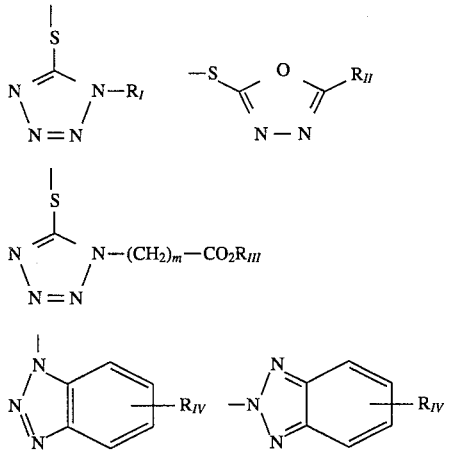

wherein $R_I$ is selected from the group consisting of straight and branched alkyls of from 1 to about 8 carbon atoms, benzyl and phenyl groups and said groups optionally containing one or more alkoxy substituents; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. NOS. 4,438,193; 4,618,571) and groups that combine the features describe above. It is typical that the timing group or moiety is of one of the formulas:

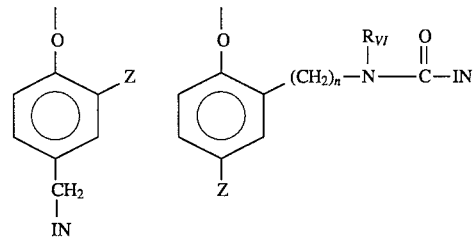

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

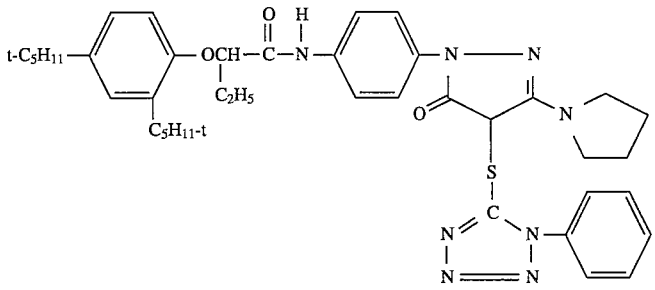

D1

-continued

D2

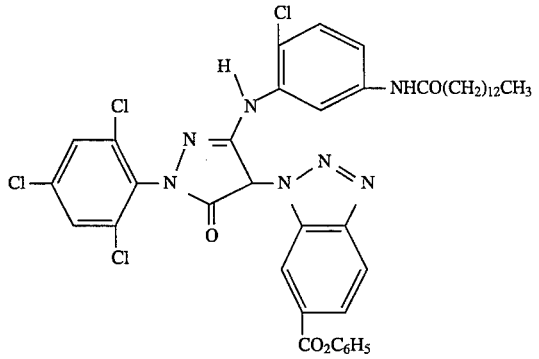

D3

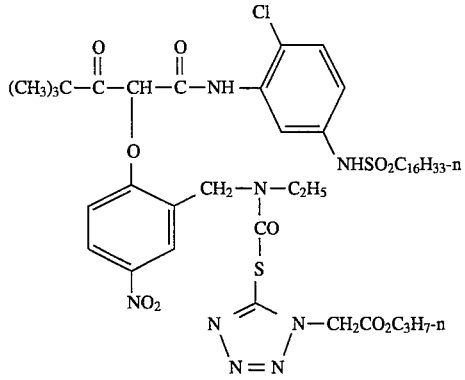

D-4

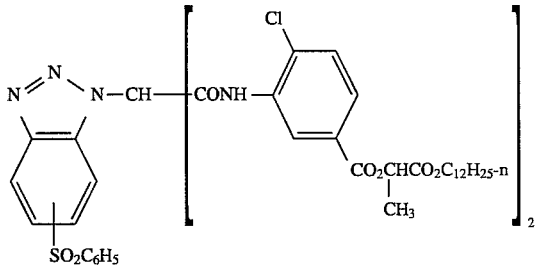

D5

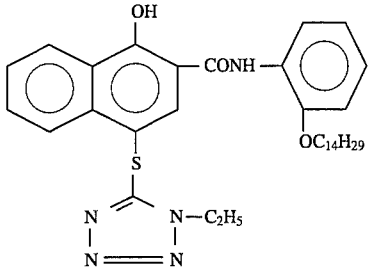

D6

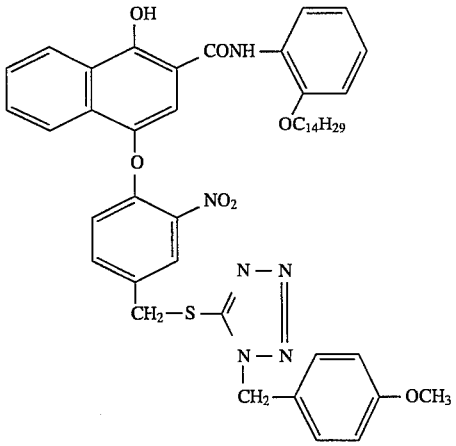

D7

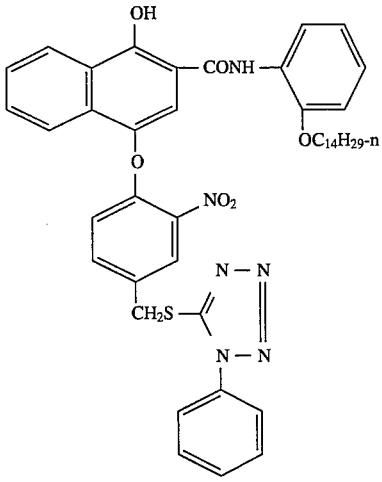

D8

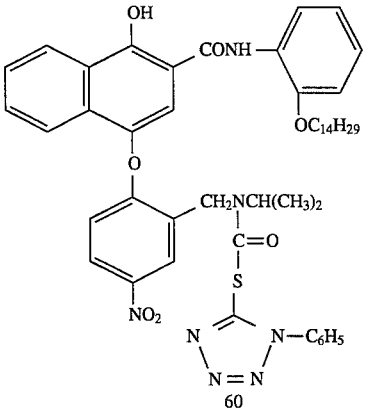

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1982, pages 209–211 and 1988, pages 191–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

EXAMPLES

The present invention is now further illustrated by reference to the following examples. The formulas for the chemicals employed are provided below.

PHOTOGRAPHIC EXAMPLE 1

A comparative control color photographic recording material (Photographic Sample 101) for color negative development was prepared by applying the following layers in the given sequence to a transparent support of cellulose acetate. The quantity of silver halide present is reported in grams of silver per square meter. All silver halide emulsions were stabilized with 1.8 grams of 4-hydroxy-6-methyl-1,3,3a,7-tetraazaindene per mole of silver.

Compounds M-1, M-2, D-2, D-7, D-9, and MM-1 were used as emulsions containing tricresylphosphate; compounds B-1, C-1, C-2, CD-2, D-3, and Y-1 were used as emulsions comprising di-n-butyl phthalate; compound D-1 was used as an emulsion comprising N-n-butyl acetanilide; compounds UV-1 UV-2, MD-1 and S-1 were used as emulsions comprising 1,4-cyclohexylenedimethylene bis-(2-ethoxyhexanoate).

Layer 1 {Antihalation Layer} black colloidal silver sol containing 0.34 g/sq.m of silver with 2.44 g/sq.m gelatin.

Layer 2 {Lowest Sensitivity Red-Sensitive Layer} Red sensitized silver iodobromide emulsion [3.8 mol % iodide, average grain diameter 0.83 micron, average grain thickness 0.09 micron] at 0.43 g/sq.m, cyan dye-forming image coupler C-1 at 0.75 g/sq.m , DIR compound D-7 at 0.043 g/sq.m, oxidized developer scavenger S-1 at 0.003 g/sq.m, and gelatin at 1.78 g/sq.m.

Layer 3 {Medium Sensitivity Red-Sensitive Layer} Red sensitized silver iodobromide emulsion [4 mol % iodide, average grain diameter 1.3 microns, average grain thickness 0.10 micron] at 0.54 g/sq.m, cyan dye-forming image coupler C-1 at 0.19 g/sq.m, DIR compound D-7 at 0.043 g/sq.m, cyan dye-forming masking coupler CM-1 at 0.032 g/sq.m, oxidized developer scavenger S-1 at 0.003 g/sq.m, and gelatin at 1.10 g/sq.m.

Layer 4 {Highest Sensitivity Red-Sensitive Layer} Red sensitized silver iodobromide emulsion [4 mol % iodide, average grain diameter 2.0 microns, average grain thickness 0.14 microns] at 1.18 g/sq.m, cyan dye-forming image coupler C-2 at 0.23 g/sq.m, DIR compound D-7 at 0.048 g/sq.m, DIR compound D-9 at 0.003 g/sq.m, cyan dye-forming masking coupler CM-1 at 0.027 g/sq.m, oxidized developer scavenger S-1 at 0.003 g/sq.m, and gelatin at 1.88 g/sq.m.

Layer 5 {Interlayer} Compensatory printing density dye YD-1 at 0.09 g/sq.m and gelatin at 1.29 g/sq.m.

Layer 6 {Lowest Sensitivity Green-Sensitive Layer} Green sensitized silver iodobromide emulsion [4 mol % iodide, average grain diameter 0.65 microns, average thickness 0.09 microns] at 0.75 g/sq.m, magenta dye-forming image coupler M-1 at 0.22 g/sq.m, magenta dye-forming image coupler M-2 at 0.065 g/sq.m, DIR compound D-1 at 0.011 g/sq.m, DIR compound D-2 at 0.002 g/sq.m, magenta dye-forming masking coupler MM-1 at 0.032 g/sq.m, oxidized developer scavenger S-1 at 0.003 g/sq.m, and gelatin at 1.56 g/sq.m.

Layer 7 {Medium Sensitivity Green-Sensitive Layer} Green sensitized silver iodobromide emulsion [4 mol % iodide, average grain diameter 1.4 microns, average thickness 0.12 microns] at 0.97 g/sq.m, magenta dye-forming image coupler M-1 at 0.086 g/sq.m, magenta dye-forming image coupler M-2 at 0.027 g/sq.m, DIR compound D-1 at 0.011 g/sq.m, DIR compound D-2 at 0.002 g/sq.m, magenta dye-forming masking coupler MM-1 at 0.027 g/sq.m, oxidized developer scavenger S-1 at 0.003 g/sq.m, and gelatin at 1.51 g/sq.m.

Layer 8 {Highest Sensitivity Green-Sensitive Layer} Green sensitized silver iodobromide emulsion [4 mol % iodide, average grain diameter 2.3 microns, average grain thickness 0.09 microns] at 0.97 g/sq.m, magenta dye-forming image coupler M-1 at 0.086 g/sq.m, magenta dye-forming image coupler M-2 at 0.027 g/sq.m, magenta dye-forming masking coupler MM-1 at 0.018 g/sq.m, DIR compound D-1 at 0.010 g/sq.m, DIR compound D-2 at 0.002 g/sq.m, oxidized developer scavenger S-1 at 0.005 g/sq.m, and gelatin at 1.83 g/sq.m.

Layer 9 {Interlayer} Yellow filter dye YD-2 at 0.11 g/sq.m, and gelatin at 1.29 g/sq.m.

Layer 10 {Lowest Sensitivity Blue-Sensitive Layer} Blue sensitized silver iodobromide emulsion [3.6 mol % iodide, average grain diameter 0.9 microns, average grain thickness 0.1 micron] at 0.27 g/sq.m, blue sensitized silver iodobromide emulsion [6.0 mol % iodide, average grain diameter 1.0 microns, average grain thickness 0.10 micron] at 0.30 g/sq.m, yellow dye-forming image coupler Y-1 at 1.18 g/sq.m, DIR compound D-3 at 0.059 g/sq.m, processing sensitivity stabilizing coupler B-1 at 0.003 g/sq.m, and gelatin at 1.94 g/sq.m.

Layer 11 {Highest Sensitivity Blue-Sensitive Layer} Blue sensitized silver iodobromide emulsion [13 mol % iodide, average grain diameter 1.7 microns, average grain thickness 0.28 microns] at 0.70 g/sq.m, yellow dye-forming image coupler Y-1 at 0.17 g/sq.m, DIR compound D-3 at 0.065 g/sq.m, and gelatin at 1.21 g/sq.m.

Layer 12 {Protective Layer 1} 0.108 g/sq.m of dye UV-1, 0.118 g/sq.m of dye UV-2, unsensitized silver bromide Lippmann emulsion at 0.22 g/sq.m, dye CD-2 at 0.005 g/sq.m, dye MD-1 at 0.001 g/sq.m, and gelatin at 0.54 g/sq.m.

Layer 13 {Protective Layer 2} Anti-matte polymethylmethacrylate beads at 0.054 g/sq.m, and gelatin at 0.89 g/sq.m.

This film was hardened at coating with 2.0% by weight of total gelatin of hardener H-1. Surfactants, coating aids, scavengers, soluble absorber dyes and stabilizers were added to the various layers of this sample as is commonly practiced in the art.

Photographic recording material Samples 102–107 were prepared in the same manner as Sample 101 except that bleach accelerator releasing coupler B-1 was added to the high, medium, and/or low sensitivity red-sensitive layers respectively as shown in Table 1. Sample 106 differed further by the addition of 0.043 g/sq.m of bleach accelerator releasing coupler B-23 to the lowest sensitivity green-sensitive layer. Compound B-23 was used as an emulsion comprising tricresylphosphate.

Samples of Photographic Samples 101–107 were individually exposed to white light of a color temperature of 5500 K, or to red light at a color temperature of 3000 K using a KODAK Wratten 29 gelatin filter through a graduated density step tablet. The samples were then processed using a color negative process, the KODAK C-41 process, as described in the British Journal of Photography Annual of 1988 in pages 196–198 (KODAK is a trademark of the Eastman Kodak Company, U.S. A.). The bleach used in the process was modified so as to contain 1,3 propylene diamine tetraacetic acid.

The red, green, and blue status M density at each exposure point was determined, and the neutral exposure and color separation contrast or gamma function was determined using a KODAK Model G Gradient Meter calculator. The gamma is the ratio of the change in density and the change in the base-10 logarithm of exposure. The gamma ratio for the red layer (gamma of the red layer after a red light exposure divided by the gamma of the red layer after a neutral exposure) was determined. This gamma ratio is a measure of the degree of color saturation that can be reproduced in photographs of red-colored objects. A larger value indicates a higher level of color saturation or "colorfulness". Table 1 reports the neutral gamma and the red gamma ratio for Samples 101 to 107. It will be appreciated that the desired neutral gamma for best tone scale for a red sensitive color record ranges approximately between 0.62–0.65, when the photographic recording material is treated and analyzed in this fashion.

A second set of Samples 101–107 was exposed to white light at 5000K through a graduated density, stepped tablet and subjected to color negative processing using the C-41 process. The bleach used in the process was modified by dilution with 30% by volume of water and adjustment of the pH to 6.4, in order to simulate a trade-seasoned, under-replenished bleach. The retained silver metal in the maximum density region of the exposed photographic recording materials was determined using x-ray fluorescence spectroscopy, and is reported in Table I.

TABLE I

| Sample No. | | BAR in Red-Sensitive Layers (g/m²) High | Medium | Low | Neutral Gamma | Color Saturation Red Gamma/ Neutral Gamma | Retained Silver (g/m²) |
|---|---|---|---|---|---|---|---|
| 101 | Comp | 0.0 | 0.0 | 0.0 | 0.48 | 1.50 | 0.197 |
| 102 | Comp | 0.13 | 0.0 | 0.0 | 0.98 | 1.10 | 0.061 |
| 103 | Comp | 0.0 | 0.13 | 0.0 | 0.80 | 1.19 | 0.067 |
| 104 | Comp | 0.04 | 0.04 | 0.04 | 0.80 | 1.19 | 0.064 |
| 105 | Inv. | 0.0 | 0.0 | 0.13 | 0.61 | 1.38 | 0.073 |
| 106 | Inv. | 0.02 | 0.0 | 0.11 | 0.69 | 1.23 | 0.058 |
| 107 | Inv. | 0.02 | 0.04 | 0.06 | 0.75 | 1.23 | 0.059 |

Photographic Samples 101 to 104 illustrate the deleterious effect on neutral gamma and color saturation of placement of a compound releasing a solubilized aliphatic mercaptan in the high or medium sensitivity layer of the color unit.

Photographic Samples 105 to 107 demonstrate surprisingly that neutral contrast increase and color saturation loss can be diminished to insignificant levels, while excellent bleachability in a degraded, simulated seasoned bleach is produced, by placement of more of the BAR compound in the least sensitive layer of the three-layer color unit, than in other layers of the color unit.

As further illustration that desired color saturation and tone scale can be provided by placement of more of BAR compound in the least sensitive layer of a triple-coated color unit than in another layer of the unit, another color negative recording material of substantially reduced silver coverage was prepared.

PHOTOGRAPHIC EXAMPLE 2

A color photographic recording material (Photographic Sample 201) for color negative development was prepared by applying the following layers in the given sequence to a transparent support of cellulose acetate. The quantities of silver halide are given in g of silver per square meter. The quantities of other materials are given in g per square meter. All silver halide emulsions were stabilized with 2 grams of 4-hydroxy-6-methyl-1,3,3a,7-tetraazaindene per mole of silver.

Compounds M-1, M-2, D-7, D-9, MM-1, and B-23 were used as emulsions containing tricresylphosphate; compounds B-1, C-1, C-2, D-3, D-12, CD-2, and Y-1 were used as emulsions comprising di-n-butyl phthalate; compound D-1 was used as an emulsion comprising N-n-butyl acetanilide; compounds UV-1, UV-2, and MD-1 were used as emulsions comprising 1,4-cyclohexylenedimethylene bis-(2-ethoxyhexanoate).

Layer 1 {Antihalation Layer} black colloidal silver sol containing 0.215 g/sq.m o#silver, dye UV-1 at 0.075 g, dye MD-1 at 0.022 g/sq.m, MM-2 at 0.097 g/sq.m, scavenger S-1 at 0.11 g/sq.m with 1.08 g/sq.m gelatin.

Layer 2 {Interlayer} Oxidized developer scavenger S-2 at 0.11 g/sq.m and 1.08 g/sq.m of gelatin.

Layer 3 {Lowest Sensitivity Red-Sensitive Layer} Red sensitized silver iodobromide emulsion [3.8 mol % iodide, average grain diameter 0.4 microns, average grain thickness 0.1 micron] at 0.25 g/sq.m, cyan dye-forming image coupler C-1 at 0.60 g/sq.m, DIR compound D-7 at 0.016 g/sq.m, cyan dye-forming masking coupler CM-1 at 0.054 g/sq.m, BAR compound B-1 at 0.032 g/sq.m with gelatin at 1.29 g/sq.m.

Layer 4 {Medium Sensitivity Red-Sensitive Layer} Red sensitized silver iodobromide emulsion [4 mol % iodide, average grain diameter 0.56 microns, average grain thickness 0.14 micron] at 0.43 g/sq.m, cyan dye-forming image coupler C-2 at 0.15 g/sq.m, DIR compound D-7 at 0.027 g/sq.m, cyan dye-forming masking coupler CM-1 at 0.032 g/sq.m with gelatin at 1.29 g/sq.m.

Layer 5 {Highest Sensitivity Red-Sensitive Layer} Red sensitized silver iodobromide emulsion [4 mol % iodide, average grain diameter 1 microns, average grain thickness 0.12 microns] at 0.41 g/sq.m, cyan dye-forming image coupler C-2 at 0.09 g/sq.m, DIR compound D-7 at 0.032 g/sq.m, DIR compound D-9 at 0.005 g/sq.m, cyan dye-forming masking coupler CM-1 at 0.011 g/sq.m with gelatin at 1.18 g/sq.m.

Layer 6 {Interlayer} Oxidized developer scavenger S-2 at 0.11 g/sq.m and 1.08 g/sq.m of gelatin.

Layer 7 {Lowest Sensitivity Green-Sensitive Layer} Green sensitized silver iodobromide emulsion [4 mol % iodide, average grain diameter 0.4 microns, average thickness 0.1 microns] at 0.16 g/sq.m, magenta dye-forming image coupler M-1 at 0.11 g/sq.m, magenta dye-forming image coupler M-2 at 0.16 g/sq.m, DIR compound D-1 at 0.006 g/sq.m, magenta dye-forming masking coupler MM-1 at 0.054 g/sq.m, BAR compound B-23 at 0.022 g/sq.m with gelatin at 0.86 g/sq.m.

Layer 8 {Medium Sensitivity Green-Sensitive Layer} Green sensitized silver iodobromide emulsion [4 mol % iodide, average grain diameter 0.56 microns, average thickness 0.14 microns] at 0.48 g/sq.m, magenta dye-forming image coupler M-1 at 0.09 g/sq.m, magenta dye-forming image coupler M-2 at 0.045 g/sq.m, DIR compound D-1 at 0.009 g/sq.m, magenta dye-forming masking coupler MM-1 at 0.032 g/sq.m, with gelatin at 1.29 g/sq.m.

Layer 9 {Highest Sensitivity Green-Sensitive Layer} Green sensitized silver iodobromide emulsion [4 mol % iodide, average grain diameter 1 microns, average grain thickness 0.12 microns] at 0.38 g/sq.m, magenta dye-forming image coupler M-1 at 0.032 g/sq.m, magenta dye-forming image coupler M-2 at 0.016 g/sq.m, magenta dye-forming masking coupler MM-1 at 0.011 g/sq.m, DIR compound D-2 at 0.003 g/sq.m, DIR compound D-12 at 0.01 g/sq.m, with gelatin at 1.13 g/sq.m.

Layer 10 {Interlayer} Oxidized developer scavenger S-2 at 0.11 g/sq.m, dye YD-2 at 0.15 g/sq.m with 1.08 g/sq.m of gelatin.

Layer 11 {Lowest Sensitivity Blue-Sensitive Layer} Blue sensitized silver iodobromide emulsion [3.6 mol % iodide, average grain diameter 0.4 microns, average grain thickness 0.1 micron] at 0.15 g/sq.m, blue sensitized silver iodobromide emulsion [3.6 mol % iodide, average grain diameter 0.56 microns, average grain thickness 0.14 micron] at 0.19 g/sq.m, yellow dye-forming image coupler Y-1 at 0.94 g/sq.m, DIR compound D-3 at 0.054 g/sq.m, with gelatin at 1.72 g/sq.m.

Layer 12 {Highest Sensitivity Blue-Sensitive Layer} Blue sensitized silver iodobromide emulsion [4 mol % iodide, average grain diameter 1 microns, average grain thickness 0.13 microns] at 0.40 g/sq.m, yellow dye-forming image coupler Y-1 at 0.16 g/sq.m, DIR compound D-3 at 0.032 g/sq.m, with gelatin at 1.72 g/sq.m.

Layer 13 {Protective Layer 1} 0.108 g/sq.m of dye UV-1, 0.118 g/sq.m of dye UV-2, unsensitized silver bromide Lippmann emulsion at 0.108 g/sq.m, dye CD-2 at 0.006 g/sq.m, Polymer Latex A at 1.08 g/sq.m with gelatin at 1.08 g/sq.m and surfactant PF-1.

Layer 14 {Protective Layer 2} Anti-matte polymethylmethacrylate beads at 0.0538 g/sq.m with gelatin at 0.91 g/sq.m and surfactant PF-2.

This film was hardened at coating with 2% by weight to total gelatin of hardener H-1. Surfactants, coating aids, scavengers, soluble absorber dyes and stabilizers were added to the various layers of this sample as is commonly practiced in the art.

Polymer Latex A is n-Butyl acrylate / 2 -acrylamido-2-methylpropane sulfonic acid/2-acetoacetoxyethyl methacrylate–(88:5:7)–Tg=–28° C.

Samples of Photographic Sample 201 were individually exposed to white light, red light or green light through a graduated density test object. The samples were then processed using a color negative process, the KODAK C-41 process as described in the British Journal of Photography Annual of 1988 at pages 196–198 (KODAK is a trademark of the Eastman Kodak Company, USA). The bleach used in the process was modified so as to comprise 1,3 propylene diamine tetraacetic acid.

The neutral and color separation sensitometry of the samples was analyzed as described in Photographic Example 1. The neutral red gamma was 0.57 The gamma ratio for the red layer (gamma of the red layer after a red light exposure divided by the gamma of the red layer after a neutral exposure was 1.15. The neutral green gamma was 0.64. The gamma ratio for the green sensitive layer (gamma of the green layer after a green light exposure divided by the gamma of the green layer after a neutral exposure was 1.12.

EXAMPLE 3

As additional illustration that desired color saturation, tone scale, and bleachability can be provided by placement of more of BAR compound in the least sensitive layer of a triple-coated color unit than in another layer of the unit, another color negative recording material was prepared.

Photographic Example 3: a color photographic recording material (Photographic Sample 301) for color negative development was prepared by applying the following layers in the given sequence to a transparent support of cellulose acetate. The quantities of silver halide are given in grams of silver per square meter. The quantities of other materials are given in grams per square meter.

Compounds S-1, MD-1, D-2, D-7, D-9, and MM-1, were used as emulsions containing tricresylphosphate; compound M-3 was used as an emulsion comprising ST-1 and tricresylphosphate; compounds C-1, D-3, D-12, CD-1, Y-1, and Y-2 were used as emulsions comprising di-n-butyl phthalate; compound D-1 was used as an emulsion comprising N-n-butyl acetanilide; compound B-1 was used as an emulsion with N,N-diethyl dodecanamide; compounds UV-1 and UV-2 were used as emulsions comprising 1,4-cyclohexylenedimethylene bis-(2-ethoxyhexanoate).

Layer 1 {Antihalation Layer} black colloidal silver sol containing 0.15 g/m$^2$ of silver, dye UV-1 at 0.075 g, dye UV-2 at 0.075 g/m$^2$, dye MD-1 at 0.014 g/m$^2$, MM-2 at 0.113 g/m$^2$, dye CD-1 at 0.034 g/m$^2$, scavenger S-1 at 0.16 g/m$^2$ with 2.44 g/m$^2$ gelatin.

Layer 2 {Lowest Sensitivity Red-Sensitive Layer} A blend of slower red sensitized tabular silver iodobromide emulsion [1.3 mol % iodide, average grain diameter 0.5 micron, average grain thickness 0.08 micron] at 0.41 g/m$^2$ and faster red sensitized tabular silver iodobromide emulsion [4.1 mol % iodide, average grain diameter 1.1 microns, average grain thickness 0,091 micron] at 0.44 g/m$^2$, cyan dye-forming image coupler C-1 at 0.54 g/m$^2$, cyan dye-forming masking coupler CM-1 at 0.027 g/m$^2$, BAR compound B-1 at 0.038 g/m$^2$ with gelatin at 1.78 g/m$^2$.

Layer 3 {Medium Sensitivity Red-Sensitive Layer} Red sensitized tabular silver iodobromide emulsion [4.1 mol % iodide, average grain diameter 1.3 microns, average grain thickness 0.12 micron] at 0.70 g/m$^2$, cyan dye-forming image coupler C-1 at 0.23 g/m$^2$, DIR compound D-1 at 0.011 g/m$^2$, cyan dye-forming masking coupler CM-1 at 0.022 g/m$^2$ with gelatin at 1.62 g/m$^2$.

Layer 4 {Highest Sensitivity Red-Sensitive Layer} Red sensitized tabular silver iodobromide emulsion [4.1 mol % iodide, average grain diameter 2.8 microns, average grain thickness 0.13 micron] at 1.08 g/m$^2$, cyan dye-forming image coupler C-1 at 0.14 g/m$^2$, DIR compound D-7 at 0.048 g/m$^2$, DIR compound D-1 at 0.020 g/m$^2$, cyan dye-forming masking coupler CM-1 at 0.032 g/m$^2$ with gelatin at 1.63 g/m$^2$.

Layer 5 {Interlayer} 1.29 g/m$^2$ of gelatin.

Layer 6 {Lowest Sensitivity Green-Sensitive Layer} A blend of slower green sensitized tabular silver iodobromide emulsion [1.3 mol % iodide, average grain diameter 0.54 micron, average thickness 0.08 micron] at 0.54 g/m$^2$, faster green sensitized tabular silver iodobromide emulsion [4.1 mol % iodide, average grain diameter 1.0 microns, average thickness 0.092 micron] at 0.28 g/m$^2$, magenta dye-forming image coupler M-3 at 0.26 g/m$^2$, magenta dye-forming masking coupler MM-1 at 0.065 g/m$^2$, with gelatin at 1.72 g/m$^2$.

Layer 7 {Medium Sensitivity Green-Sensitive Layer} Green sensitized tabular silver iodobromide emulsion [4.1 mol % iodide, average grain diameter 1.3 microns, average thickness 0.13 micron] at 0.97 g/m$^2$, magenta dye-forming image coupler M-3 at 0.081 g/m$^2$, DIR compound D-1 at 0.024 g/m$^2$, magenta dye-forming masking coupler MM-1 at 0,065 g/m$^2$, with gelatin at 1.43 g/m$^2$.

Layer 8 {Highest Sensitivity Green-Sensitive Layer} Green sensitized tabular silver iodobromide emulsion [4.1 mol % iodide, average grain diameter 2.3 microns, average grain thickness 0.13 micron] at 0.97 g/m$^2$, magenta dye-forming image coupler M-3 at 0.062 g/m$^2$, magenta dye-forming masking coupler MM-1 at 0.054 g/m$^2$, DIR compound D-2 at 0.011 g/m$^2$, DIR compound D-12 at 0,011 g/m$^2$, with gelatin at 1.28 g/m$^2$.

Layer 9 {Interlayer} Dye YD-2 at 0.11 g/m$^2$ with 1.29 g/m$^2$ of gelatin.

Layer 10 {Lowest Sensitivity Blue-Sensitive Layer} A blend of slower blue sensitized tabular silver iodobromide emulsion [1.3 mol % iodide, average grain diameter 0.53 micron, average grain thickness 0.09 micron] at 0.25 g/m$^2$, faster blue sensitized silver iodobromide emulsion [6.0 mol % iodide, average grain diameter 0.95 micron, average grain thickness 0.25 micron] at 0.64 g/m$^2$, yellow dye-forming image coupler Y-1 at 0.70 g/m$^2$, yellow dye-forming image coupler Y-2 at 0.28 g/m$^2$, cyan dye forming coupler C-1 at 0.016 g/m$^2$, processing sensitivity stabilizing coupler B-1 at 0.003 g/m$^2$, DIR compound D-3 at 0.065 g/m2, with gelatin at 2.51 g/m$^2$.

Layer 11 {Highest Sensitivity Blue-Sensitive Layer} A blend of slower blue sensitized low aspect ratio silver iodobromide emulsion [9.0 mol % iodide, average grain diameter 1.05 microns] at 0.40 g/m$^2$, faster blue sensitized tabular silver iodobromide emulsion [4.1 mol % iodide, average grain diameter 3.3 microns, average grain thickness 0.14 micron] at 0.23 g/m$^2$, yellow dye-forming image coupler Y-1 at 0.22 g/m$^2$, yellow dye-forming image coupler Y-2 at 0.08 g/m$^2$, cyan dye forming coupler C-1 at 0.016 g/m$^2$, processing sensitivity stabilizing coupler B-1 at 0.005 g/m$^2$, DIR compound D-3 at 0.048 g/m$^2$, with gelatin at 1.61 g/m$^2$.

Layer 12 {Protective Layer 1} 0.108 g/m$^2$ of dye UV-1, 0.108 g/m$^2$ of dye UV-2, unsensitized silver bromide Lippmann emulsion at 0.22 g/m$^2$, with gelatin at 0.70 g/m$^2$.

Layer 13 {Protective Layer 2} Anti-matte polymethylmethacrylate beads at 0.054 g/m$^2$ with gelatin at 0.89 g/m$^2$.

Hardener H-1 was added to the color photographic recording material at 1.75% by weight of total gelatin. Surfactants, coating aids, scavengers, soluble absorber dyes and stabilizers were added to the various layers of this sample as is commonly practiced in the art.

Samples of Photographic Sample 301 were individually exposed to white light of a color temperature of 5500K, or to red light at a color temperature of 3000K using a KODAK Wratten 29 gelatin filter through a graduated density step tablet. The samples were then processed using a color negative process, the KODAK C-41 process, as described in the British Journal of Photography Annual of 1988 in pages 196–198 (KODAK is a trademark of the Eastman Kodak Company, USA). The bleach used in the process was modified so as to contain 1,3 propylene diamine tetraacetic acid.

The neutral and color separation sensitometry of the samples was analyzed as described in Photographic Example 1. The neutral red gamma was 0.63 The gamma ratio for the red layer (gamma of the red layer after a red light exposure divided by the gamma of the red layer after a neutral exposure was 1.27.

A second sample of Sample 301 was exposed to white light at 5000 K through a graduated density, stepped tablet and subjected to color negative processing using the C-41 process. The bleach used in the process was modified by dilution with 30% by volume of water and adjustment of the pH to 6.4, in order to simulate a trade-seasoned, under-replenished bleach. The retained silver metal in the maximum density region of the exposed photographic recording material was determined using x-ray fluorescence spectroscopy, and was found to be 0.161 g/m$^2$.

Formulas for the compounds used in the Examples are as follows:

B-1

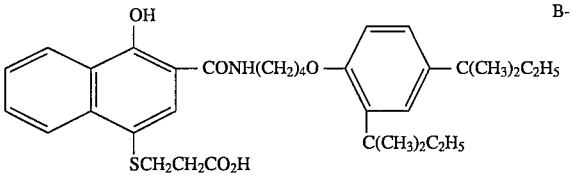

B-23

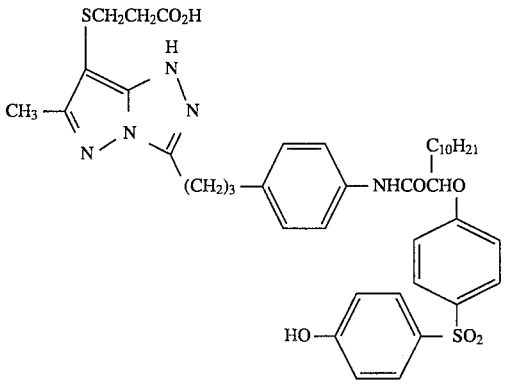

C-1

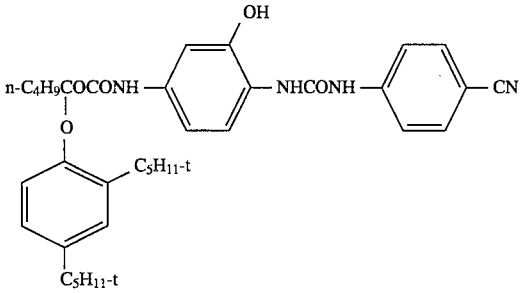

C-2

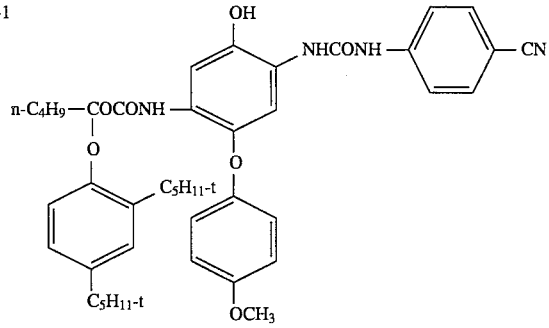

-continued
CD-1
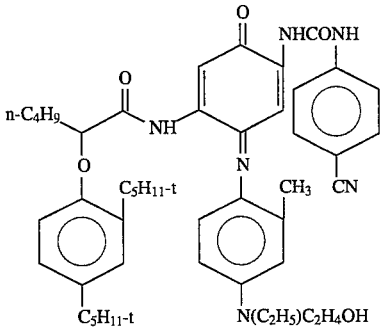
CD-2
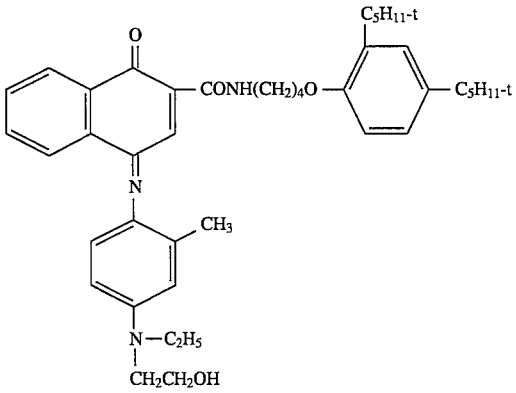
CM-1
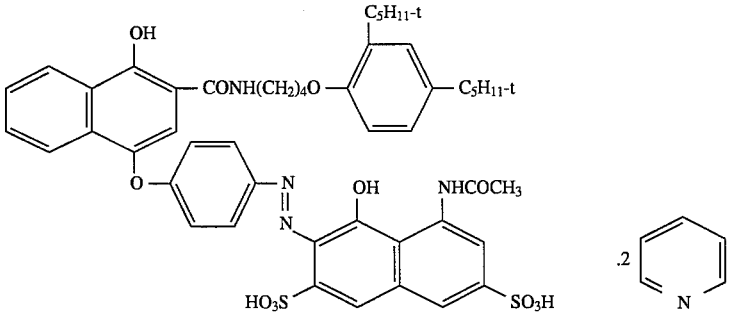
D-1
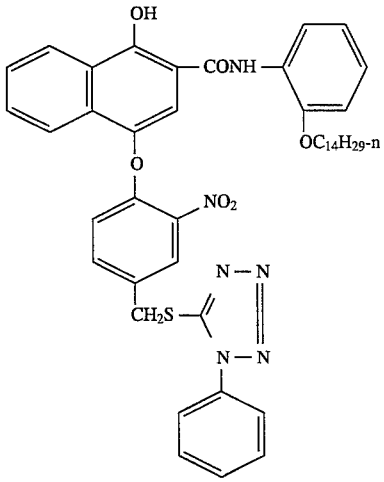
D-2
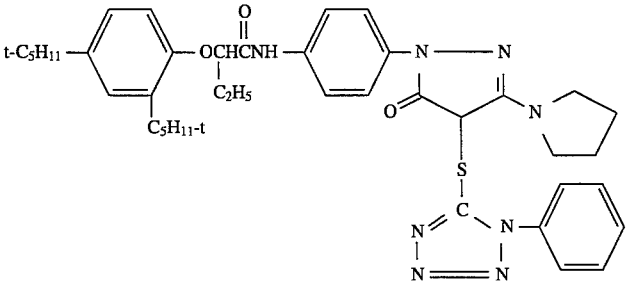

-continued
D-3
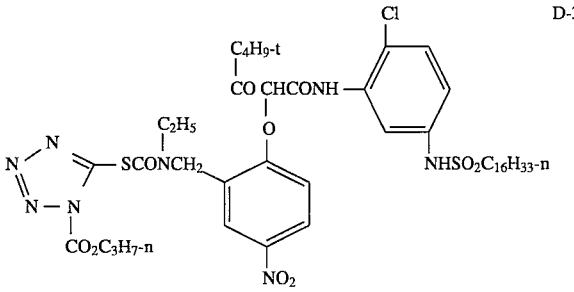
D-7
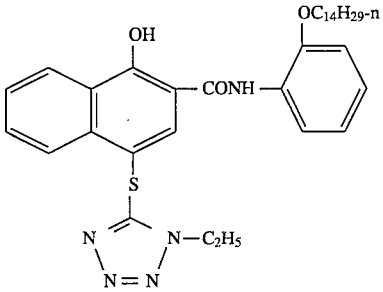
D-9
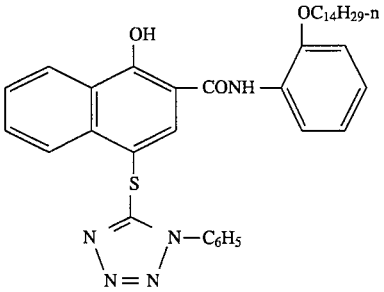
D-12
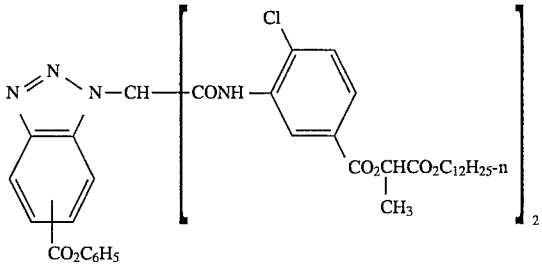
$CH_2(SO_2CH{=}CH_2)_2$ H-1
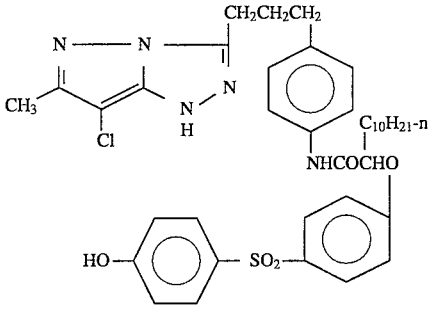
M-1
M-2
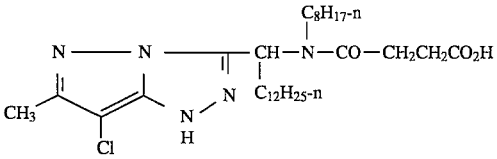
M-3
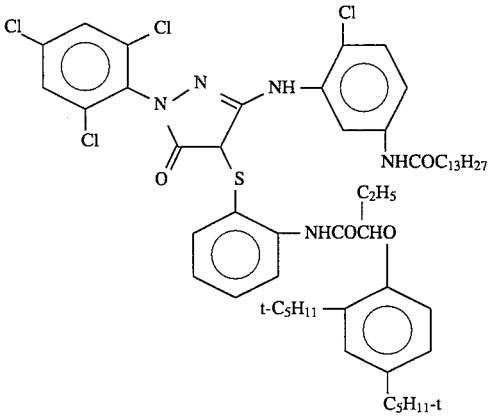

-continued
MD-1
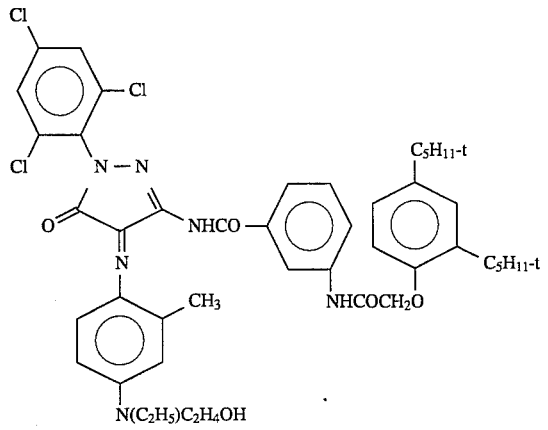
MM-1
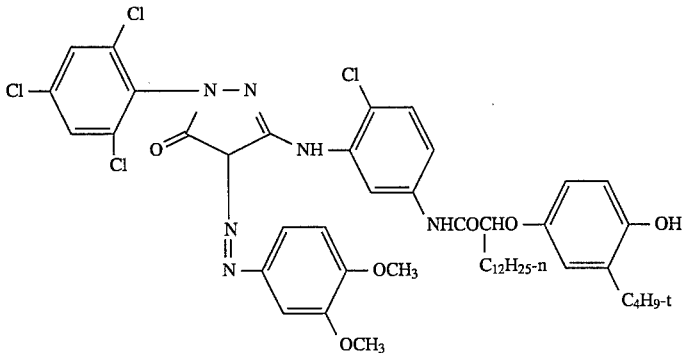
MM-2
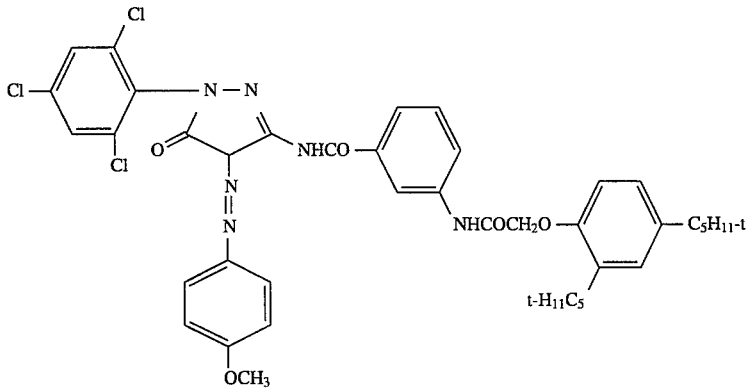
$C_8F_{17}SO_2NH(CH_2)_3N^+(CH_3)_3.I^-$ PF-1
$C_8F_{17}SO_3^-.NH_4^+$ PF-2
S-1
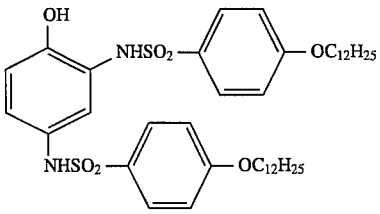
S-2
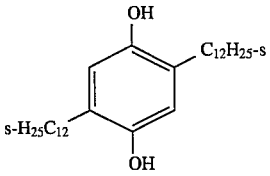
ST-1
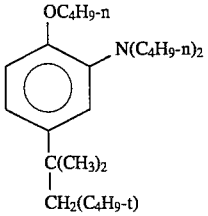

-continued

Y-1

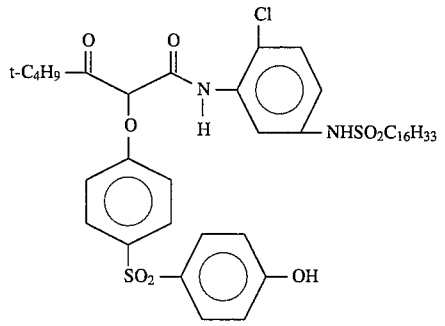

Y-2

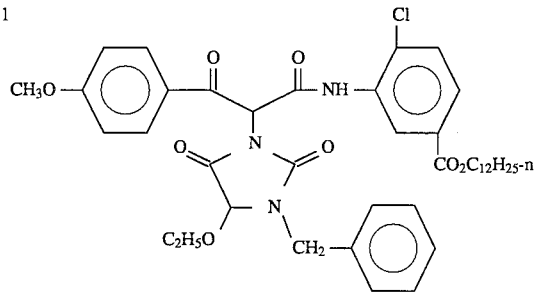

YD-1

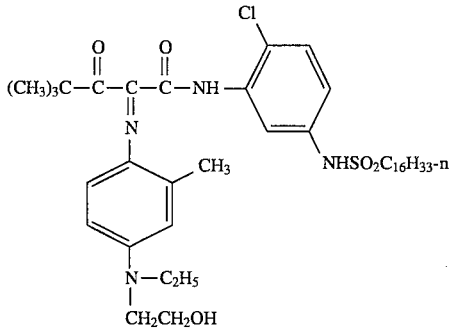

YD-2

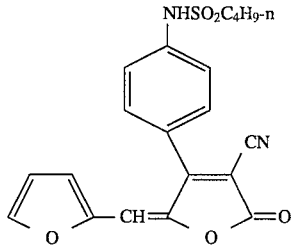

UV-1

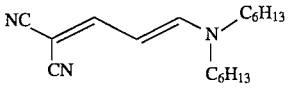

UV-2

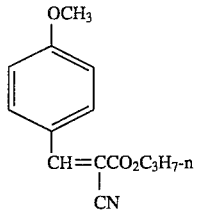

What is claimed is:

1. A photographic element comprising a masking coupler and further comprising at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment-containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an atom which is a member of an aromatic ring and the thiol fragment also contains a water-solubilizing group;

wherein the element is a color negative element.

2. The element of claim 1 wherein the solubilizing group is selected from the group consisting of carboxy and hydroxy.

3. The element of claim 1 wherein the thiol fragment or precursor is represented by the formula:

$$-L_nSR'R''$$

wherein L is a divalent linking group which releases —SR'R" as a group during processing; n is 0 to 3; R' is a substituent group which is connected to S through other than an atom which is a member of an aromatic ring; and R" is a water solubilizing group.

4. The element of claim 3 wherein said least sensitive layer is sensitized in the red spectral range.

5. The element of claim 3 wherein L is a linking group selected from the group consisting of alkylene, arylene and combinations thereof, interrupted or not by a heterogroup, all substituted or unsubstituted.

6. The element of claim 5 wherein L is a timing group (T) selected from the group consisting of quinone methide and carbamate.

7. The element of claim 3 wherein R' is represented by the formula $$-\underset{R^2}{\overset{R^1}{(C)_m}}-$$

wherein m is 1 to 8, each $R^1$ and $R^2$ is independently hydrogen, alkyl or aryl, substituted or not, and R" is as defined in said earlier claim.

8. The element of claim 7 wherein n is 0.

9. The element of claim 7 wherein m is 2, each $R^1$ and $R^2$ is hydrogen and R" is carboxyl.

10. The element of claim 8 wherein R" is selected from the group consisting of carboxy and hydroxy.

11. The element of claim 3 wherein the compound is present in an amount of at least 0.06 mmol/sq.m.

12. The element of claim 3 wherein the thiol fragment is bonded to a coupler.

13. The element of claim 3 further comprising a support and wherein the least sensitive layer is closer to the support than the more sensitive layers.

14. The element of claim 3 wherein the compound containing the thiol fragment is represented by the formula:

$CAR—L_n—SR'R''$ wherein CAR is a coupler moiety.

15. The element of claim 14 wherein CAR is a naphthol group with the thiol fragment at the 4-position.

16. The element of claim 15 wherein CAR is represented by the formula:

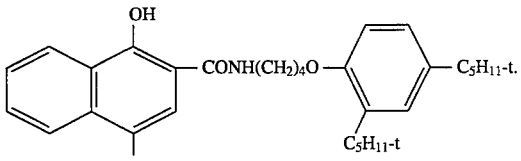

17. The element of claim 14 wherein the compound containing the thiol fragment is represented by one of the formulas:

$—SCH_2CH_2COOH$; $—SCH_2CO_2H$; $—SCH_2CH_2OH$; $—SCH_2CH_2N(CH_3)_2$; $—SCH_2CH_2SO_3H$;

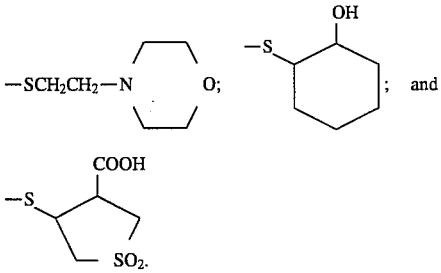

18. A photographic element comprising at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment-containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an atom which is a member of an aromatic ring and the thiol fragment also contains a water-solubilizing group, and wherein the compound containing the thiol fragment is represented by the formula:

$CAR—L_n—SR'R''$ wherein CAR is a coupler moiety which is a naphthol group with the thiol fragment at the 4-position, L is a divalent linking group which releases —SR'R" as a group during processing; n is 0 to 3; R' is a substituent group which is connected to S through other than an atom which is a member of an aromatic ring; and R" is a water solubilizing group, provided that where substitution by a substituent is indicated, the substituent is selected from the group consisting of halogen; nitro; hydroxyl; cyano; and $CO_2H$ and its salts; and from alkyl; alkenyl ; alkoxy; aryl; aryloxy; carbonamido; sulfonamido; sulfamoyl; carbamoyl; acyl; sulfonyl; sulfonyloxy; sulfinyl; thio; acyloxy; amino; imino; phosphate; phosphite; heterocyclic, heterocyclicoxy, and heterocyclicthio groups, each of which contain a 3 to 7 membered heterocyclic ring composed of carbon atoms and at least one hetero atom selected from the group consisting of oxygen, nitrogen and sulfur; quaternary ammonium; and silyloxy; where said substituents may themselves be further substituted with any of the above substituents.

19. A photographic element as in claim 18 wherein CAR is represented by the formula:

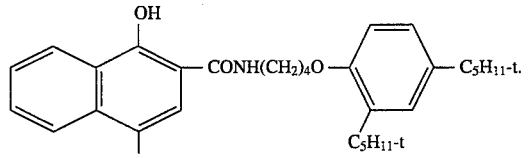

20. A process for forming a color negative image comprising imagewise exposing a photographic element containing at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment-containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an atom which is a member of an aromatic ring and the thiol fragment also contains a water-solubilizing group;

and then developing said image by a process consisting essentially of contacting said exposed element with a color developing agent whereby a color negative image is formed.

21. The process of claim 20 wherein the thiol fragment or precursor is represented by the formula:

$—L_nSR'R''$ wherein L is a divalent linking group which releases —SR'R" as a group during processing; n is 0 to 3; R' is a substituent group which is connected to S through other than an atom which is a member of an aromatic ring; and R" is a water solubilizing group.

22. The process of claim 20 wherein said least sensitive layer is sensitized in the red spectral range.

23. The process of claim 21 wherein L is a linking group selected from the group consisting of alkylene, arylene and combinations thereof, interrupted or not by a heterogroup, all substituted or unsubstituted.

24. The process of claim 23 wherein L is a timing group (T) selected from the group consisting of quinone methide and carbamate.

25. The process of claim 20 wherein the solubilizing group is selected from the group consisting of carboxy and hydroxy.

26. The process of claim 21 wherein R' is represented by the formula

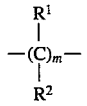

wherein m is 1 to 8, each $R^1$ and $R^2$ is independently hydrogen, alkyl or aryl, substituted or not, and R" is as defined in said earlier claim.

27. The process of claim 26 wherein n is 0.

28. The process of claim 27 wherein R" is selected from the group consisting of carboxy and hydroxy.

29. The process of claim 21 wherein the compound is present in an amount of at least 0.06 mmol/sq.m.

30. The process of claim 21 wherein the thiol fragment is bonded to a coupler.

31. The process of claim 21 wherein the least sensitive layer is closer to the support than the more sensitive layers.

32. The process of claim 26 wherein m is 2, each $R^1$ and $R^2$ is hydrogen and R" is carboxyl.

33. The process of claim 21 wherein the compound containing the thiol fragment is represented by the formula:

$$CAR—L_n—SR'R''$$

wherein CAR is a coupler moiety.

34. The process of claim 33 wherein CAR is a naphthol group with the thiol fragment at the 4-position.

35. The process of claim 34 wherein CAR is represented by the formula:

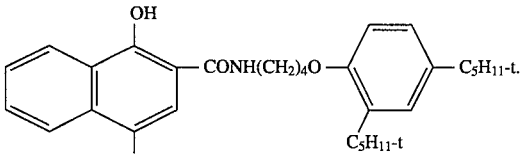

36. The process of claim 33 wherein the compound containing the thiol fragment is represented by one of the formulas:

$—SCH_2CH_2COOH$; $—SCH_2CO_2H$; $—SCH_2CH_2OH$; $—SCH_2CH_2N(CH_3)_2$; $—SCH_2CH_2SO_3H$;

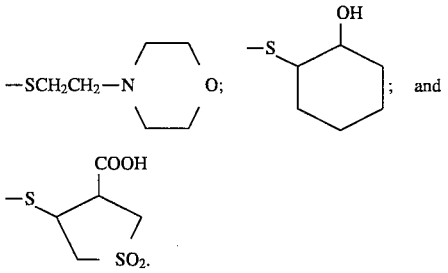

37. A photographic element comprising at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment-containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an atom which is a member of an aromatic ring and the thiol fragment also contains a water-solubilizing group, and wherein the thiol fragment or precursor is represented by the formula:

$$—L_nSR'R''$$

wherein L is a divalent linking group, selected from the group consisting of alkylene, arylene and combinations thereof, interrupted or not by a heterogroup, all substituted or unsubstituted, which releases —SR'R" as a group during processing; n is 0 to 3; R' is a substituent group which is connected to S through other than an atom which is a member of an aromatic ring; and R" is a water solubilizing group, provided that where substitution by a substituent is indicated, the substituent is selected from the group consisting of halogen; nitro; hydroxyl; cyano; and $CO_2H$ and its salts; and from alkyl; alkenyl; alkoxy; aryl; aryloxy; carbonamido; sulfonamido; sulfamoyl; carbamoyl; acyl; sulfonyl; sulfonyloxy; sulfinyl; thio; acyloxy; amino; imino; phosphate; phosphite; heterocyclic, heterocyclicoxy, and heterocyclicthio groups, each of which contain a 3 to 7 membered heterocyclic ring composed of carbon atoms and at least one hetero atom selected from the group consisting of oxygen, nitrogen and sulfur; quaternary ammonium; and silyloxy; where said substituents may themselves be further substituted with any of the above substituents.

38. A photographic element comprising at least three light sensitive silver halide layers spectrally sensitized to the same region of the electromagnetic spectrum wherein the least sensitive such layer, or a nonsensitive layer adjacent thereto, comprises a compound which contains a releasable thiol fragment or a precursor thereof wherein:

A. the amount of the thiol fragment-containing compound or precursor in such layers is both sufficient to increase the extent of silver bleaching during bleaching and is greater than the amount contained in any of the more sensitive layers of the same sensitivity; and B. the thiol fragment contains a sulfur atom which is not directly bonded to an atom which is a member of an aromatic ring and the thiol fragment also contains a water-solubilizing group, and wherein the thiol fragment or precursor is represented by the formula:

$$—L_nSR'R''$$

wherein L is a timing group (T) selected from the group consisting of quinone methide and carbamate which releases —SR'R" as a group during processing; n is 0 to 3; R' is a substituent group which is connected to S through other than an atom which is a member of an aromatic ring; and R" is a water solubilizing group, provided that where substitution by a substituent is indicated, the substituent is selected from the group consisting of halogen; nitro; hydroxyl; cyano; and $CO_2H$ and its salts; and from alkyl; alkenyl; alkoxy; aryl; aryloxy; carbonamido; sulfonamido; sulfamoyl; carbamoyl; acyl; sulfonyl; sulfonyloxy; sulfinyl; thio; acyloxy; amino; imino; phosphate; phosphite; heterocyclic, heterocyclicoxy, and heterocyclicthio groups, each of which contain a 3 to 7 membered heterocyclic ring composed of carbon atoms and at least one hetero atom selected from the group consisting of oxygen, nitrogen and sulfur; quaternary ammonium; and silyloxy: where said substituents may themselves be further substituted with any of the above substituents.

* * * * *